US005357167A

United States Patent [19]

Mathews et al.

[11] Patent Number: 5,357,167

[45] Date of Patent: Oct. 18, 1994

[54] HIGH PRESSURE DISCHARGE LAMP WITH A THERMALLY IMPROVED ANODE

[75] Inventors: Paul G. Mathews, Chesterland; Rocco T. Giordano, Garfield Heights; Gary R. Allen, Chesterland; Timothy P. Dever, Fairview Park; Viktor K. Varga, Willoughby Hills; Jeffrey D. Johnson, Mentor, all of Ohio

[73] Assignee: General Electric Company, Schenectady, N.Y.

[21] Appl. No.: 910,487

[22] Filed: Jul. 8, 1992

[51] Int. Cl.[5] ..... H01J 17/10; H01J 61/06

[52] U.S. Cl. ..... 313/632; 313/344

[58] Field of Search ..... 313/631, 632, 633, 344

[56] References Cited

U.S. PATENT DOCUMENTS

| | | | |
|---|---|---|---|
| 2,306,925 | 12/1942 | Aicher et al. | 313/344 X |
| 2,879,427 | 3/1959 | Delrieu | 313/185 |
| 3,067,357 | 12/1962 | Fridrich | 313/633 |
| 3,170,081 | 2/1965 | Rokosz | 313/213 |
| 3,313,974 | 4/1967 | Koury et al. | 313/218 |
| 3,405,303 | 10/1968 | Koury et al. | 313/217 |
| 3,979,624 | 9/1976 | Liu et al. | 313/229 |
| 4,044,276 | 8/1977 | Keeffe et al. | 313/218 |
| 4,052,634 | 10/1977 | De Kok | 313/184 |
| 4,052,636 | 10/1977 | Strok | 313/217 |
| 4,105,908 | 8/1978 | Harding et al. | 313/217 |
| 4,150,317 | 4/1979 | Laska et al. | 313/221 |
| 4,319,158 | 3/1982 | Watanabe et al. | 313/346 R |
| 4,321,503 | 3/1982 | Bhalla | 313/211 |
| 4,396,856 | 8/1983 | Ogata et al. | 313/632 |
| 4,559,473 | 12/1985 | McVey | 313/630 |
| 4,783,611 | 11/1988 | Vogels et al. | 313/25 |
| 4,847,534 | 7/1989 | der Kinderen | 313/628 |
| 5,001,397 | 3/1991 | Der Kinderen | 313/631 X |

FOREIGN PATENT DOCUMENTS 58-107712 6/1983 Japan .

*Primary Examiner*—Sandra L. O'Shea

*Attorney, Agent, or Firm*—George E. Hawranko; Stanley C. Corwin

[57] ABSTRACT

A high pressure discharge lamp with a thermally improved anode, as well as a method of making such a lamp, are disclosed. The lamp includes a refractory arc tube with a hermetically sealed arc chamber, a fill in the arc chamber for facilitating light generation, and an anode and a cathode extending into the hermetically sealed arc chamber and being spaced apart from each other. The anode comprises a shank of refractory metal, a cylindrically shaped refractory metal sleeve on a portion of the shank, and an end proximally facing the cathode. The anode end comprises a substantially solid mass of refractory metal, and is integrally joined to both the shank and the metal sleeve to facilitate heat flow from the anode end to the shank and sleeve. The anode end preferably is generally shaped as a hemisphere facing the cathode. The refractory metal sleeve is preferably one or more layers of a helically wound refractory metal wire having an outer diameter more than twice a diameter of the shank.

19 Claims, 4 Drawing Sheets

HIGH PRESSURE DISCHARGE LAMP WITH A THERMALLY IMPROVED ANODE

CROSS-REFERENCE TO RELATED APPLICATION

This application is related to the commonly owned, co-pending application entitled "High Brightness Discharge Light Source," Ser. No. 07/858,906, filed on Mar. 27, 1992, by Mathews et al. The entire disclosure of such related application is incorporated herein my reference.

FIELD OF THE INVENTION

The present invention relates to a high pressure discharge lamp with a thermally improved anode, and to a method of making a lamp of this type.

BACKGROUND OF THE INVENTION

The thermal design of electrodes of high pressure discharge lamps has become increasingly important in developing improved lamp designs. In a xenon-metal halide lamp, for instance, the thermal design of the anode electrode ("anode") and cathode electrode ("cathode") has become especially important. A xenon-metal halide lamp includes, in an arc chamber, a fill of metal and metal-halide substances promoting light generation, including xenon at a relatively high pressure, e.g. 6 atmospheres at room temperature. The xenon is stimulated to substantial light emission almost immediately upon energizing the lamp with a relatively high starting current. A typical starting current is 6 amps for about 3 seconds, for a 60 watt lamp. The starting current is followed by current ramping down to a considerably lower, steady state level of about 1 amp, for example, over the next 10 seconds, for a 60 watt lamp. Especially in the d.c. mode of operation, the high initial current causes especially pronounced heating of the anode, which should thus have a high heat capacity. The anode is also heated continuously during lamp operation in the process of receiving electron-current flow from the cathode during d.c. operation.

Further, especially where a xenon-metal halide lamp is vertically oriented, i.e. with its cathode positioned vertically above its anode, a molten metal halide pool typically covers about the lower third of the inside wall of the lamp, near the anode, during lamp operation. Efficient thermal management calls for the anode to be designed to facilitate heat radiation into the metal halide pool, to increase the halide vapor pressure, and thereby increase light output. To prevent the anode heat from being diverted down the supporting shank of the anode, the diameter of the anode shank can be minimized.

A prior art approach to thermally managing an anode of a xenon-metal halide lamp is to form the anode with a considerably larger mass than the cathode, and to machine the anode from a single, relatively large workpiece of refractory metal, by electric discharge machining, for instance. By so machining a single workpiece, a relatively large anode tip can be formed with a small diameter supporting shank, to minimize heat flow through such shank. Further, the outer surface of the anode tip can be textured in the machining process so as to increase the anode surface area available for radiating heat into the metal halide pool.

A shortcoming of machining an anode from a single workpiece in the foregoing manner is that the machining process is time-consuming and expensive. It would thus be desirable to provide a more economical method of making a high pressure discharge lamp with a thermally improved anode.

SUMMARY OF THE INVENTION

It is, accordingly, an object of the invention to provide a more economical method of making a high pressure discharge lamp with a thermally improved anode, and also to provide a high pressure discharge lamp with a thermally improved anode.

A further object of the invention is to provide a lamp and method of the foregoing type wherein the thermally improved anode can be fabricated using commonplace manufacturing equipment.

In accordance with the invention, a high pressure discharge lamp with a thermally improved anode is provided. The lamp comprises a refractory arc tube with an internal, hermetically sealed arc chamber containing a fill for facilitating light generation. An anode and a cathode extend into the hermetically sealed arc chamber, and are spaced from each other. The anode includes a shank of refractory metal and a cylindrically shaped refractory metal sleeve on a portion of the shank. The anode further includes an end proximally facing the cathode, and comprising a substantially solid mass of refractory metal that is integrally joined to both the shank and the metal sleeve. Such anode end is preferably shaped generally as a hemisphere facing the cathode. The sleeve preferably comprises at least one layer of a helically wound refractory metal wire.

The foregoing lamp has an anode that is thermally improved according to the criteria mentioned in the background above.

In accordance with another aspect of the invention, a method for making a high pressure discharge lamp having a thermally improved anode is provided. The method includes the steps of providing a cathode and an anode for placing in spaced relation with each other. The anode is formed by providing a refractory metal shank and sleeve, and placing the sleeve along a portion of the shank to form a sleeve-shank combination. A portion of the sleeve-shank combination, while held facing downwards, is heated sufficiently to cause metal from the sleeve-shank combination to ball up and form an end that integrally joins both the shank and the metal sleeve. Such heating step preferably includes heating the mentioned portion of the sleeve-shank combination sufficiently to cause metal from the combination to ball up and form a generally hemispherical anode end. The refractory metal sleeve preferably comprises at least one layer of a helically wound refractory metal wire. The method further includes the step of providing a refractory arc tube with an internal, hermetically sealed arc chamber for containing the anode and cathode. A fill of substances for facilitating light generation is also provided in the arc chamber.

The foregoing method provides an anode that is thermally improved according to the criteria mentioned in the background above, and can be made economically on commonplace equipment.

The above-described objects, together with further advantages of the invention, will become apparent from the following description taken together with the accompanying drawings.

DETAILED DESCRIPTION OF THE PREFERRED EMBODIMENTS

Figure 1:
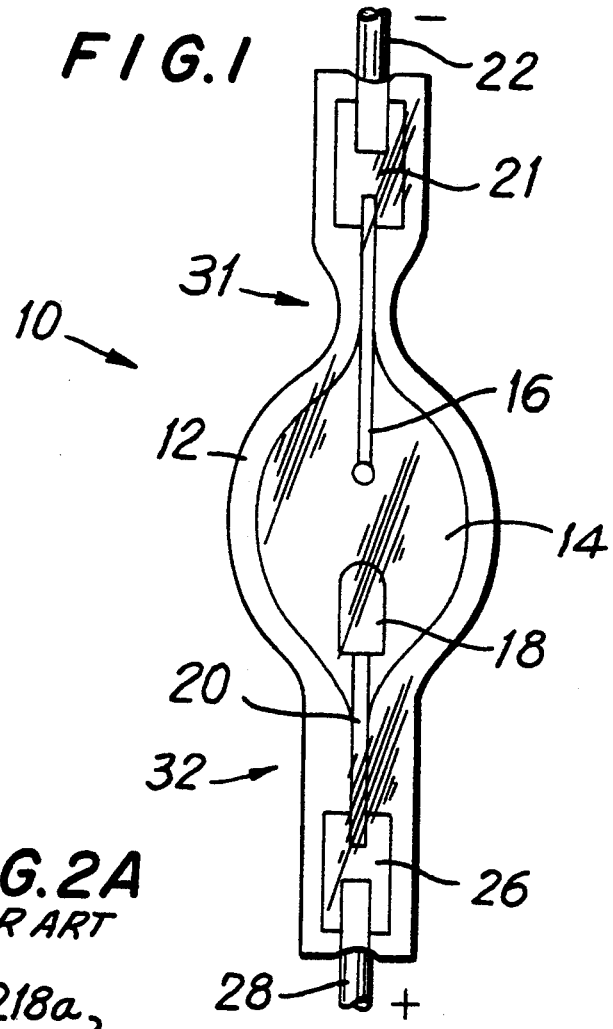
FIG. 1 is a schematic view of a high pressure discharge lamp incorporating a thermally improved anode in accordance with the invention.

FIG. 1 schematically shows a high pressure discharge lamp 10 that may utilize the principles of the present invention. Lamp 10 includes an arc tube 12 of refractory transparent material, such as fused quartz, which forms an arc chamber 14. Positioned within arc chamber 14 are a cathode 16 and an anode 18, both of refractory metal, such as tungsten or molybdenum or their alloys, which may include additives such as 1 to 3% thoria, for instance. Arc chamber 14 includes a suitable fill of materials to facilitate light generation when heated by an electric arc (not shown) between cathode 16 and anode 18.

For a high pressure xenon-metal halide discharge lamp, a typical fill includes mercury, metal halide, and xenon at a relatively high pressure, e g , 6 atmospheres at room temperature. A typical fill for a high pressure mercury discharge lamp, in contrast, includes mercury and an inert fill gas; and a typical fill for a high pressure sodium lamp includes sodium, an inert fill gas, and, for some lamps, an amalgam of mercury and sodium.

In lamp 10 of FIG. 1, cathode 16 is connected by a metal foil 21, typically molybdenum, to a conventional outer lead conductor 22. Similarly, anode 18, shown schematically, is connected by a metal foil 26 to a conventional outer lead conductor 28. Anode 18 is shown schematically and is referred to hereinafter as the anode "tip." The "+" and "−" signs in FIG. 1 indicate that lamp 10 may be supplied with direct current, but it could also operate with alternating current if the anode and cathode were similar to each other. Although not shown, respective windings may wrap cathode 16 and anode shank 20 in their respective neck portions 31 and 32 of arc tube 12, to facilitate axial alignment of cathode 16 and anode 18 within arc tube 12. Such an arrangement is disclosed in U.S. Pat. No. 4,968,916, assigned to the instant assignee.

Lamp 10 may be operated as shown with cathode 16 positioned vertically above anode 18, although the lamp could also be rotated from the position shown; for instance, the lamp could be rotated such that cathode 16 and anode 18 are at the same vertical level. Further, lamp 10 may be alternatively configured with both cathode 16 and anode 18 supplied with electric power from a single end of the lamp; that is, with both the respective outer lead conductors 22 and 28 for cathode 16 and anode 18 extending into lamp 10 from a single side.

Figure 2A:
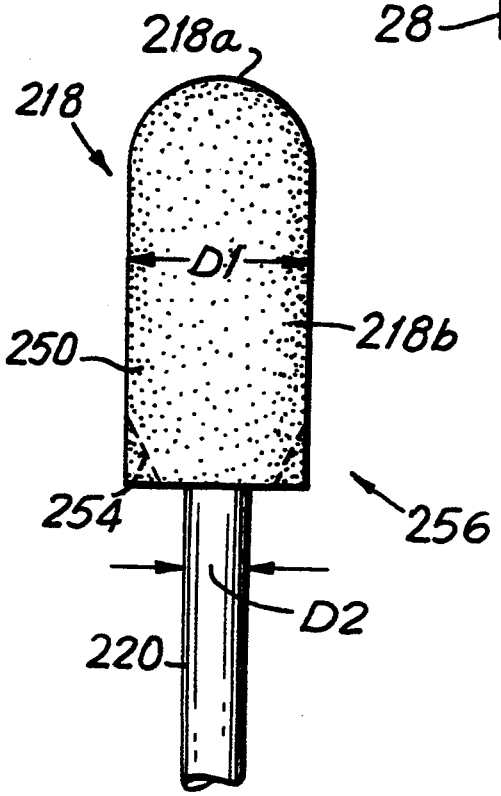
FIG. 2A PRIOR ART
FIG. 2A shows a prior art thermally improved anode.

The thermal design requirements for anode tip 18 and its supporting shank 20 are described with reference to prior art FIG. 2, which shows an anode tip 218 and a supporting shank 220. Tip 218 and supporting shank 220 are both of refractory metal, such as mentioned above in connection with cathode 16 and anode 18. Anode tip 218 includes a generally hemispherically shaped end **218*a* proximally facing a cathode (not shown), and a cylindrically shaped body 218*b* supporting the hemispherical end 218*a*. Cylindrical body 218*b*, in turn, is supported on anode shank 220**.

Prior art anode tip 218 and supporting shank 220 are configured to meet three principal thermal design criteria when the lamp is operated in a rapid-on mode described above. As a first criterion, to withstand the high heat load on the anode due to the initially high start-up current, anode 218 requires a high heat capacity, which may be achieved by forming anode tip 218 with a diameter D1 of about 52 mils (1.3 mm) over a length for anode tip 218 of about 120 mils (3 mm).

Figure 2B:
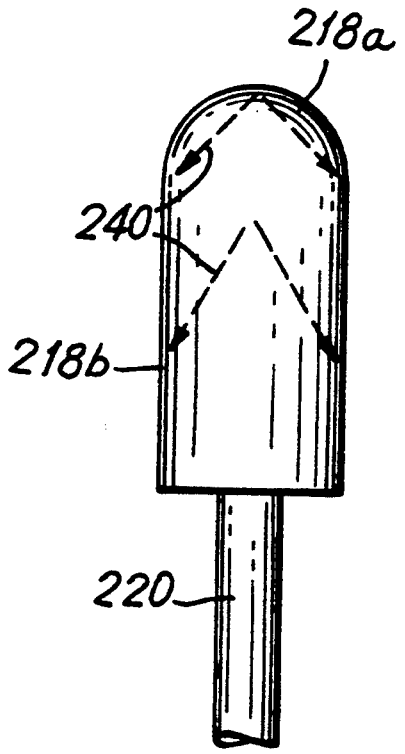
FIG. 2B PRIOR ART
FIG. 2B shows thermal flow paths within the prior art anode of FIG. 2A.

For a xenon-metal halide lamp 10 oriented vertically as shown in FIG. 1, a metal halide pool (not shown) typically covers about the lower third of the inside wall of arc chamber 14, near the anode. Lamp operation is improved by configuring anode tip 218 (FIG. 2) to radiate heat generated during lamp operation to its environs, by raising the vapor pressure of the nearby metal halide. FIG. 2B shows heat flow paths 240, in dashed lines, indicating heat flow originating from an arc (not shown) on anode end **218*a* and passing axially into cylindrical body 218*b*. The heat is then preferentially directed radially outwardly to the surface of such cylindrical anode body, from which the heat is lost preferentially by radiation and also by conduction and convection to the gas. This second thermal design criterion is achieved in the prior art anode of FIG. 2A by texturizing the radially outer surface 250 of cylindrical body 218*b***, as indicated by stippling, so as to increase the surface area available for heat transfer.

A third thermal design criterion is to minimize the amount of heat flowing down shaft 220, and hence unavailable for radiating onto a nearby metal halide pool. This is achieved by reducing the diameter D2 of supporting shank 220 to, e.g., 16 mils (0.4 mm) e.g. compared with the 52-mil (1.3-mm) diameter D1 of anode body **218*b***.

It is also desirable for anode end **218*a* to be shaped generally as a hemisphere. By eliminating sharp points from the anode end, a hemispherical shape has been found to minimize the erosion of anode 218, and hence make more constant the often-crucial design parameter of the gap separating anode 218 from a cooperating cathode (not shown). Additionally, it has been found that the prior art anode of FIG. 2A can be desirably modified by removing material to expose surface 254. This forms a tapered body that may desirably achieve a more uniform spacing between the anode body and the surrounding arc tube, which serves to avoid overheating the wall of an arc chamber by a pointed rear surface 256** of the body, and also to provide more uniform heating of the molten metal halides.

While the prior art anode of FIG. 2 adequately fulfills the thermal design criteria mentioned above, such anode is typically made with a slow, and hence expensive, machining process, such as electric discharge machining. An important object of the invention is to provide a more economical method of making a high pressure discharge lamp having an anode that meets the foregoing design criteria.

Figure 3:
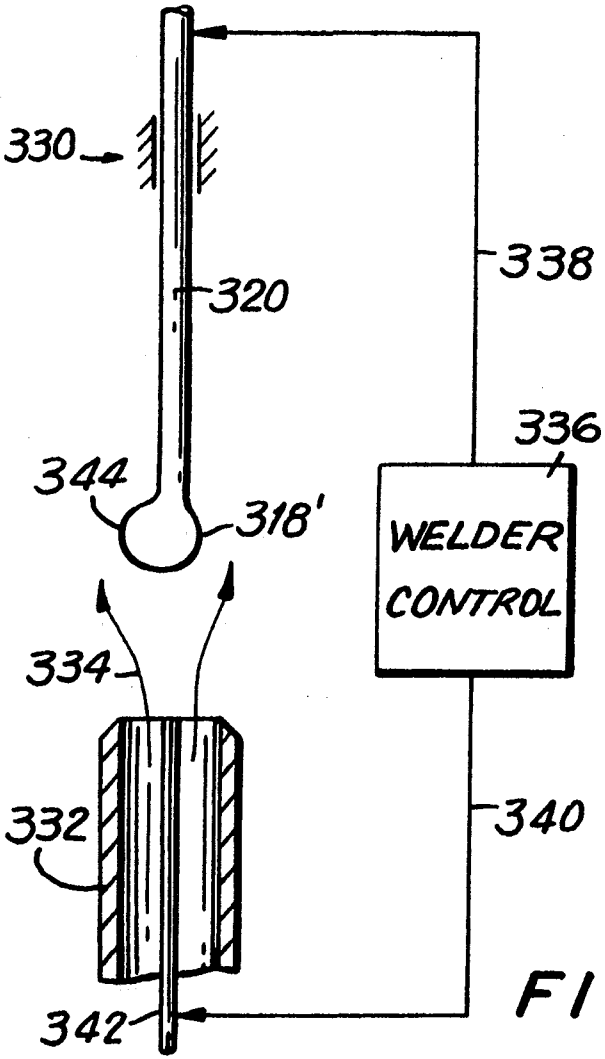
FIG. 3 is a schematic view of a welding arrangement for explaining difficulties in forming a thermally improved anode for a high pressure discharge lamp.

FIG. 3 shows a welding arrangement for explaining an initial, but unsuccessful, attempt to more economically make a suitable anode. FIG. 3 shows a refractory metal shank 320, typically of 16-mil (0.4-mm) diameter, held in place by a clamp 330 of a plasma welder. The welder includes a nozzle 332 through which an inert gas such as argon is directed onto anode shank 320, as shown by arrows 334, to prevent oxidation of the shank. A welder control 336 suitably controls the current through conductors 338 and 340, which are respectively applied to anode shank 320 and to an electrode 342 of the plasma welder, to cause melting of the lower portion of anode shank 320.

In the unsuccessful attempt of FIG. 3, a first difficulty arose in that anode tip 318' could be enlarged, by melting, only to about twice the diameter of supporting shank 320. Therefore, a 25-mil (0.63-ram) shank would be required to support a 50-rail (1.25-mm) diameter anode tip 318'. Enlarging the diameter of shank 320 in this way, however, would increase undesirable heat conduction though the shank, away from anode tip 318'. Secondly, a serious difficulty arose in reliably aligning anode tip 318' with shank 320, particularly where the anode tip diameter approached twice the diameter of the shank. Anode tip 318' is thus shown undesirably biased to the left at 344. Additionally, the thermal mass and outer surface area of tip 318' as not as large as those of the elongated cylindrical tip of anode 218.

Figure 4A:
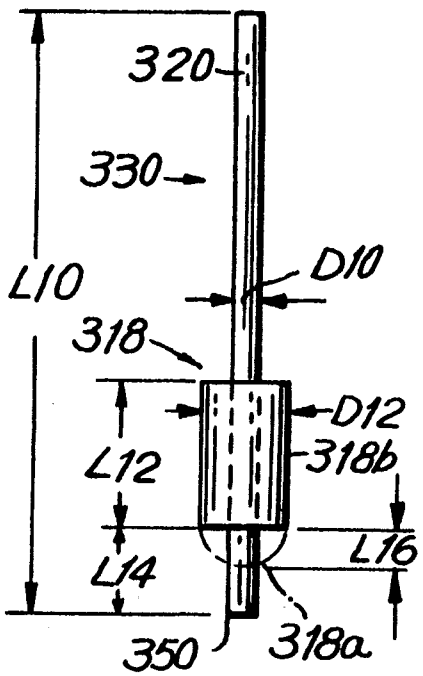
FIG. 4A illustrates dimensions of a metal sleeve mounted on an anode shank that undergoes the welding procedure of FIG. 4.
Figure 4:
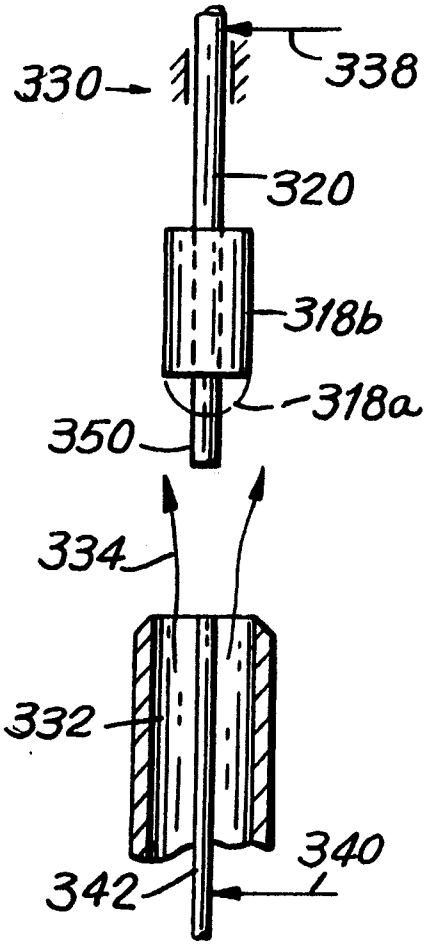
FIG. 4 is a schematic view similar to FIG. 3, but showing a successful approach to producing a thermally improved anode.

Using the same plasma welder as in FIG. 3, FIG. 4 shows how an anode according to the present invention can be made. In the illustrated method, a generally cylindrical sleeve **318*b* of refractory metal is first suitably secured onto shank 320. This may be accomplished, for instance, by electric resistance welding, which forces electric current to flow between anode body 318*b* and anode shank 320. The sleeve may alternatively be attached to the shank by mechanical crimping, or by a mechanically snug fit. The sleeve, however, need not be directly secured to the shank, but could be held in place by a suitable holding fixture during the welding process of FIG. 4. In the illustrated process, end portion 350 of shank 320 is sufficiently melted to "ball" back preferably to a generally hemispherical shape 318*a* (shown in phantom), having a diameter substantially the same as that of cylindrical body 318*b*. The welding process of FIG. 4 has been shown to reliably align anode end 318*a* with anode shank 320, as well as with cylindrical body 318*b***.

Referring to FIG. 4A, anode tip 318 and supporting shank 320 typically have the following dimensions for a 60-watt xenon-metal halide lamp with a 6- amp starting current. Shank 320 may have a length L10 of 15 mm and a diameter D10 of 16 mils (0.4 mm), which may vary considerably including, but not restricted to a range from about 10 to 20 mils (0.25 to 0.5 mm) Anode sleeve **318*b* may have a diameter D12 of about 52 mils (1.3 mm), although such diameter may also vary considerably, including, but not restricted to, the range from about 40 to 60 mils (1 to 1.5 mm). The length L12 of anode body 318*b* may be about 93 mils (2.35 mm), although it may vary considerably, including, but not restricted to, the range from about 80 to 160 mils (2 to 4 mm). Length L14 of shank end 350 may be about 4.7 mm long where shank diameter D10 is 16 mils (0.4 mm) and sleeve diameter D12 is 52 mils (1.3 mm); such length L14, however, may vary considerably, including, but not restricted to, the range from about 0 to 20 mm. Length L16 of generally hemispherical anode end 318*a* is approximately ½ of diameter D12 of anode body 318*b*; however, such length L16 may be longer, to add more mass, or shorter, to improve alignment of tip 318*a* with body 318*b***.

Lamps other than the mentioned 60-watt xenon-metal halide lamp with a 6-amp starting current may naturally use dimensions differing from those in the foregoing paragraph. Further, the described welding process of FIG. 4 is merely exemplary. Thus, for instance, the metal that is melted in the welding process to form anode end **318*a* need not come primarily from the exposed anode end 350 shown in FIG. 4. Such metal, for instance, could come primarily from cylindrical sleeve 318*b***, or from both parts of the combination of the sleeve and the shank.

Typical refractory metals for anode end **318*a*, anode body 318*b* and anode shank 320 are those mentioned above in connection with cathode 16 and anode 18**.

Figure 5:
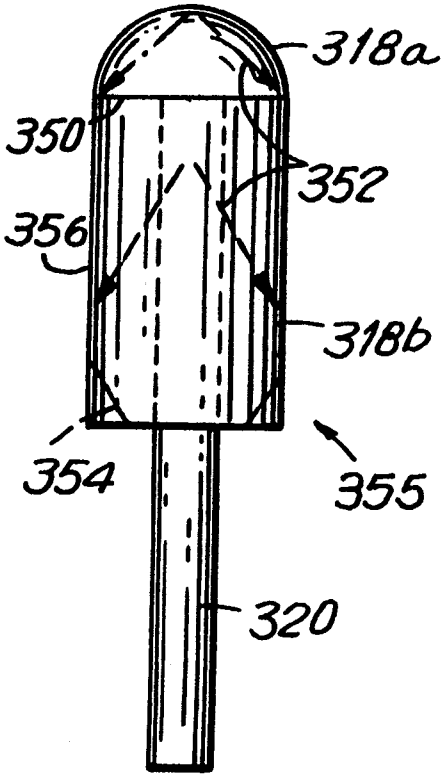
FIG. 5 shows thermal flow paths in an anode made according to the invention.

FIG. 5 shows an anode resulting from the welding 30 process of FIG. 4. As shown in FIG. 5, anode tip end **318*a* is integrally joined to both anode body 318*b* and to shank 320 at 350, thereby providing a good heat flow path 352 from anode end 318*a* to anode body 318*b*. Body 318*b* is preferably shaped prior to the welding process of FIG. 4 to expose surface 354, if desired, to assure more even spacing from an adjacent arc tube. This serves to avoid overheating the wall of an arc chamber by a pointed rear surface 355** of the body, and also to provide more uniform heating of the molten metal halides.

The anode of FIG. 5 achieves high heat capacity through the relatively high mass of generally cylindrical body **318*b*, while minimizing heat loss through shank 320 which may desirably be 16 mils (0.4 mm) or less in diameter, compared with a typical 52-mil (1.3-mm) diameter of body 318*b*. Although not shown in FIG. 5, radially outer surface 356 of body 318*b*** is preferably textured to increase the surface area available for radiating heat.

Figure 6B:
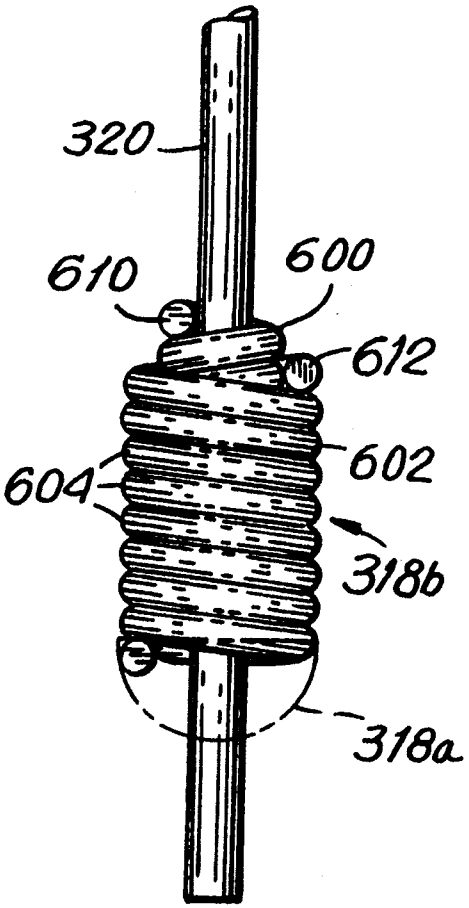
FIGS. 6A and 6B show sequential steps for forming a refractory metal sleeve that undergoes the welding procedure of FIG. 4.
Figure 6A:
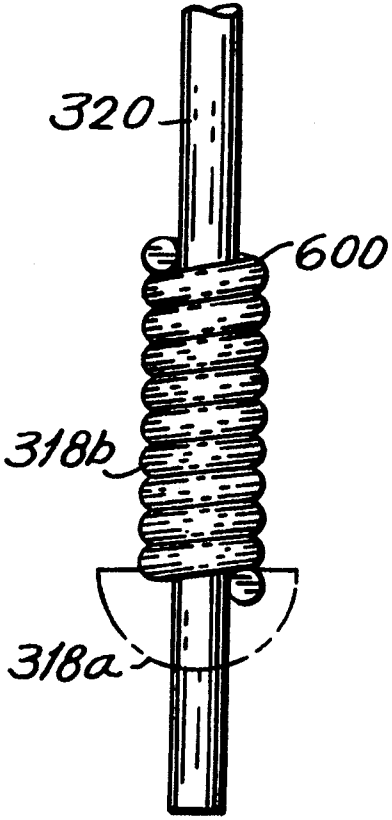

The generally cylindrical sleeve **318*b* of FIGS. 4 and 5 may be formed from a cylindrical tube of refractory metal. Alternatively, such sleeve may be formed by winding refractory metal wire around a conventional mandrel (not shown), and then positioning and securing such winding, or winding "layer" shown at 600 in FIG. 6A, on anode shank 320. Generally, the diameter of the refractory metal wire does not exceed that of shank 320. By way of example, for a 60-watt xenon-metal halide lamp with a 6-amp starting current, the wire may be 9 mils (0.23 mm) in diameter, although such diameter may vary considerably, including, but not restricted to, the range from about 5 to 12 mils (0.13 to 0.3 mm). Where winding 600 is ductile, it can be wound with a slightly smaller diameter than shank 320, so as to be secured to the shank with a snug mechanical fit. Alternatively, winding 600 can be secured to shank 320 by electric resistance welding, or otherwise suitably positioned for the welding process of FIG. 4. To further build up sleeve 318*b* to the desired diameter of anode tip 318*a*, shown in phantom, a second winding 602, shown in FIG. 6B, may be added. Winding 602 may also be of 9-mil (0.22-mm) refractory metal wire, prewound on a conventional mandrel, and then positioned atop winding 600, and secured to such winding 600, e.g., by electric resistance welding, or otherwise suitably positioned for the welding process of FIG. 4. As shown in FIG. 6B, the use of winding 602 increases the area of outer surface 604. This promotes good thermal radiation from such surface, one of the thermal design criteria mentioned above. To further increase the area of outer surface 604, one or more further windings (not shown) could be sequentially positioned atop winding 602**.

The lowermost extent of windings 600 and 602, as shown in FIG. 6B, preferably coincide, so as to both become integrally joined to anode tip 318*a*. In contrast, the inner winding 600 extends upwardly more than outer winding 602 in the arbitrary viewpoint of FIG. 6B; whereby a tapered configuration, represented approximately by a dashed line 354 in FIG. 5, is attained. Length L12 of body 318*b*, as shown in FIG. 4A, includes the length of inner winding 600.

Figure 7C:
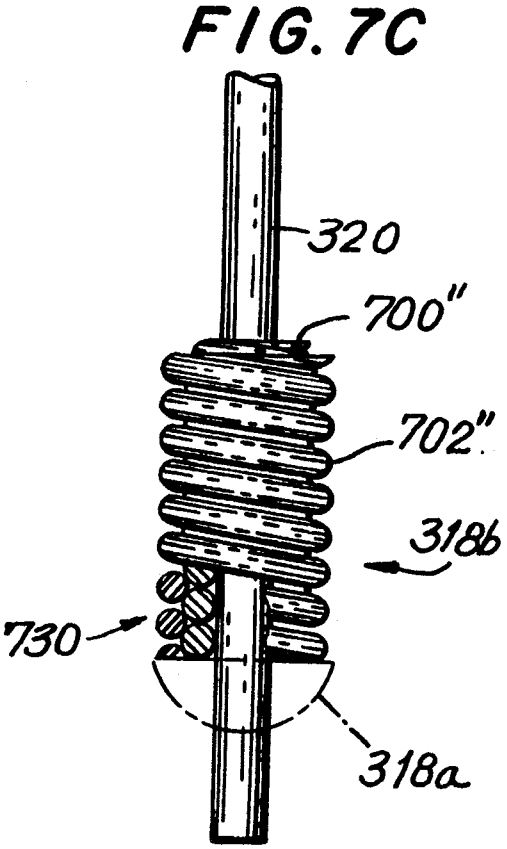
FIGS. 7A–7D show various embodiments of a metal sleeve used in the welding procedure of FIG. 4.

The use of two separate windings 600 and 602 as shown in FIG. 6B requires trimming of ends 610 and 612, which would be beneficial to avoid. Such trimming can be avoided, as shown in FIG. 7A, by using a single, continuous wire to form inner and outer windings 700 and 702. The wire is wound, in the arbitrary viewpoint of FIG. 7A, starting from the bottom and moving upwards to form inner winding 700, and then winding outer layer 702 over the inner layer. Beneficially, the lower ends of windings 700 and 702 become melted and fuse into the anode tip end 318*a* in the welding process of FIG. 4. As in FIG. 6B, in FIG. 7A it is desirable for the inner winding layer 700 to extend upwards more than the outer winding 702, from the arbitrary viewpoint of FIG. 7A, so as to realize the tapered surface 354 of FIG. 5.

Figure 7B:
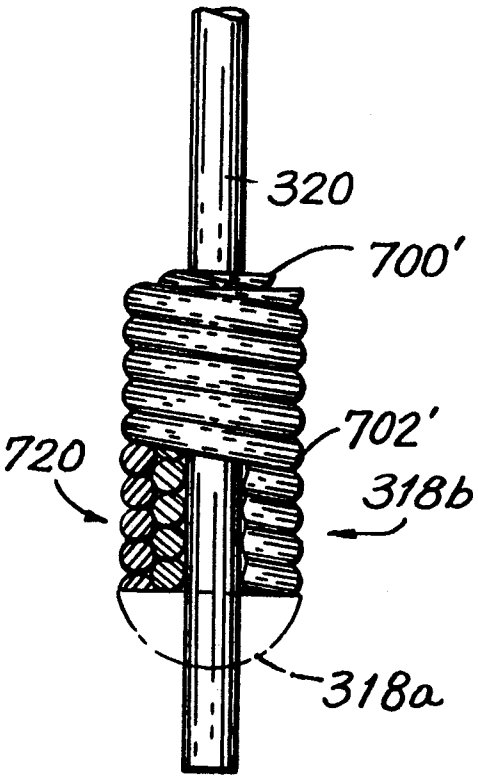
Figure 7A:
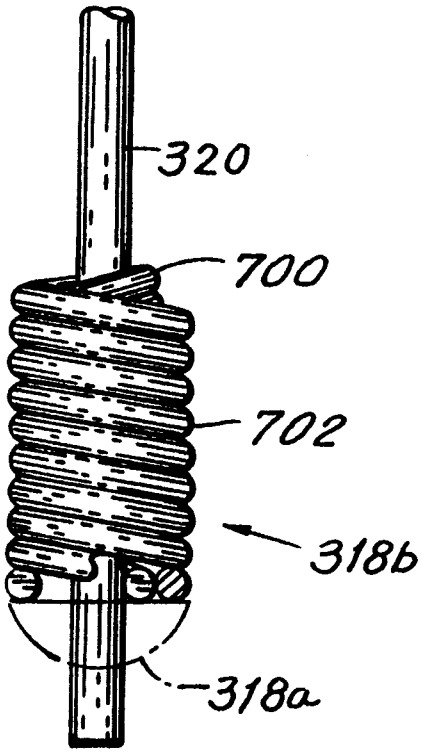

FIG. 7B shows an enhanced sleeve arrangement 318*b*, comprising separate winding layers 700' and 702' that are wound in the same rotational direction, i.e., clockwise from above in FIG. 7B. With both windings wound in the same direction, outer winding 702' can be screwed onto the inner winding 700', previously secured to anode shank 320. Outer winding 702' can then be secured to inner winding 700' by a snug mechanical fit, or by electric resistance welding, or otherwise positioned for the welding process of FIG. 4. Generally cylindrical sleeve 318*b* of FIG. 7B benefits from the close packing of winding turns of the inner and outer winding layers 700' and 702', as shown in the cut-away section at 720. The close packing increases the heat capacity of a given-diameter sleeve 318*b*, and enhances thermal conduction from the inner to the outer winding. As in FIGS. 6B and 7A, inner winding 700' preferably extends further upwards than outer winding 702' in the arbitrary viewpoint of FIG. 7B.

FIG. 7B also shows the upper ends of inner winding 700' and outer winding 702' each being cut in a horizontal plane, in the arbitrary viewpoint of that figure, in contrast to the cuts made in FIG. 6B to the upper ends 610 and 612 of inner and outer windings 600 and 602. This eliminates the need for trimming the ends of the windings shown in FIG. 7B. A planar cut of the winding can be achieved by abrasively cutting the ends of the windings, as opposed to firing the windings in hydrogen, for instance, and then chopping the ends of the windings, as at 610 and 612 in FIG. 6B.

FIG. 7C shows a further enhancement, wherein the wire forming inner layer 700'' has a greater diameter than the wire forming outer layer 702''. As shown in the cut-away section at 730, this beneficially increases the surface area available for heat transfer from cylindrical sleeve 318*b*.

Figure 7D:
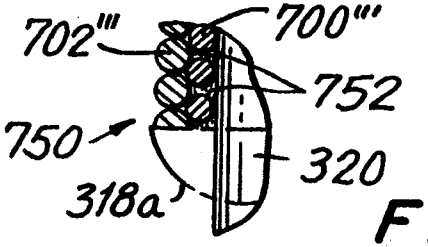

FIG. 7D is a detail of a cut-away 750 that is similar to cut-away 730 of FIG. 7C except for the following difference. Cut-away 750 shows inner layer 700''' formed from smaller-diameter wire than the outer layer 702''' the reverse of the case for FIG. 7C Adjacent turns of inner layer 700''' are therefore separated from each other by gaps that beneficially may contain emission-enhancing material, shown as the stippled regions 752, to facilitate electron emission from the electrode 18. The emission enhancing material may be achieved by use of $Ba_2 Ca WO_6$, a material commonly used for emission enhancing in high pressure sodium (HPS) lamps Outer layer 702''' beneficially holds material 752 in place.

Based on the present disclosure, those skilled in the art will find apparent other ways of forming refractory metal sleeve 318*b* used in the welding operation of FIG. 4. Sleeve 318*b*, for instance, may be formed from a single winding, or from more than two windings as specifically shown.

Several xenon-metal halide lamps using the single-point dimensions mentioned in connection with FIG. 4A were made according to the design disclosed in the above-mentioned patent application Ser. No. 07/858,906. The anode design was as shown in the appended FIGS. 6 and 7, and a cathode comprising a rod with an enlarged end proximally facing the anode was used. The lamps performed comparably to xenon-metal halide lamps employing the prior art anode of FIG. 2A in regard, for instance, to their lumen output and correlated color temperature.

The foregoing describes a high pressure discharge lamp with a thermally improved anode, and an economical method of making such a lamp.

While the invention has been described with respect to specific embodiments by way of illustration, many modifications and changes will occur to those skilled in the art. It is, therefore, to be understood that the appended claims are intended to cover all such modifications and changes as fall within the true spirit and scope of the invention.

What is claimed is:

1. A high pressure discharge lamp, comprising:

(a) a refractory arc tube with an internal, hermetically sealed arc chamber;

(b) a fill in said arc chamber for facilitating light generation; and (c) an anode and a cathode extending into said hermetically sealed arc chamber and being spaced apart from each other;

(d) said anode comprising:

(i) a generally elongate shank of refractory metal;

(ii) a cylindrically shaped refractory metal sleeve on a portion of said shank, wherein an outer diameter of the metal sleeve is more than twice a diameter of the shank; and (iii) an end proximally facing said cathode, comprising a subsantially solid mass of refractory metal, and being integrally joined to both said shank and said metal sleeve.

2. The lamp of claim 1, wherein said anode end is generally shaped as a hemisphere facing said cathode.

3. The lamp of claim 1, wherein said sleeve comprises at least one layer of a helically wound refractory metal wire.

4. The lamp of claim 3, wherein said sleeve comprises respective inner and outer layers of helically wound refractory metal wire.

5. The lamp of claim 4, wherein said inner and outer layers of wire are formed from a single connected length of wire.

6. The lamp of claim 5, wherein the two ends of said single connected length of wire are integrally joined to said anode end.

7. The lamp of claim 5, wherein said anode end is generally shaped as a hemisphere facing said cathode.

8. The lamp of claim 4, wherein:

(a) said inner and outer layers of wire are formed from respective portions of wire, both wound in the same rotational sense; and (b) the diameters of the inner and outer layers are chosen such that respective full turns of the outer layer are nested and in contact with respective pairs of adjacent, full turns of the inner layer, to achieve a high heat capacity anode.

9. The lamp of claim 8, wherein said anode end is generally shaped as a hemisphere facing said cathode.

10. The lamp of claim 8, wherein a portion of said inner winding is exposed at an end of said metal sleeve opposite said anode end, so as to taper said sleeve at said sleeve end.

11. The lamp of claim 8, wherein said inner layer of wire comprises wire with a larger diameter than wire forming said outer layer, so as to increase the surface area of said sleeve available to radiating heat.

12. A lamp of claim 4, wherein:

(a) said inner and outer layers of wire are formed from respective portions of wire, both wound in the same rotational sense;

(b) the diameters of the inner and outer layers are chosen such that respective full turns of the inner layer are nested and in contact with respective pairs of adjacent, full turns of the outer layer, so as to achieve a high heat capacity;

(c) said inner layer of wire comprises wire with a smaller diameter than wire forming said outer layer, whereby adjacent turns of the inner layer are separated from each other by respective gaps; and (d) emission-enhancing material is contained in said gaps and held by the outer layer.

13. The lamp of claim 1, wherein said outer diameter of the metal sleeve is more than three times said diameter of the shank.

14. The lamp of claim 1, wherein a length of the metal sleeve is substantially greater than said outer diameter of the metal sleeve.

15. The lamp of claim 14, wherein said length of the metal sleeve is at least twice said outer diameter of the metal sleeve.

16. The lamp of claim 1, wherein the length of the metal sleeve is sufficiently greater than said outer diameter of the metal sleeve to permit effective radiation of thermal energy.

17. The lamp of claim 1, wherein said end is formed almost exclusively from material of the shank.

18. The lamp of claim 1, wherein said end is formed from material of the shank extending beyond the metal sleeve a sufficient length to provide material to form an effective end.

19. The lamp of claim 8, wherein said inner and outer layers of wire are both tungsten.

* * * * *